United States Patent [19]

Fitzpatrick

[11] Patent Number: 5,037,090

[45] Date of Patent: Aug. 6, 1991

[54] PHYSICAL EXERCISING DEVICE

[76] Inventor: Patrick C. Fitzpatrick, 82 Calle Pensamiento, El Paraiso Baja, Estepona, Marbella, Spain

[21] Appl. No.: 457,935

[22] Filed: Dec. 27, 1989

[30] Foreign Application Priority Data

Jan. 19, 1989 [GB] United Kingdom ..... 8901146

[51] Int. Cl.[5] ..... A63B 21/00

[52] U.S. Cl. ..... 272/134; 272/130; 272/144

[58] Field of Search ..... 272/96, 130, 134, 144

[56] References Cited

U.S. PATENT DOCUMENTS

| | | | |
|---|---|---|---|
| 4,448,412 | 5/1984 | Brentham | 272/130 |
| 4,465,274 | 8/1984 | Davenport | 272/130 |
| 4,509,746 | 4/1985 | Mask | 272/134 |
| 4,834,396 | 5/1989 | Schnell | 272/134 X |
| 4,844,456 | 7/1989 | Habing et al. | 272/134 |
| 4,867,445 | 9/1989 | Connelly | 272/130 |
| 4,872,668 | 10/1989 | McGillis et al. | 272/130 |

*Primary Examiner*—Robert Bahr

*Attorney, Agent, or Firm*—Mason, Fenwick & Lawrence

[57] ABSTRACT

A free-standing physical exercising device which can also be configured for use as a posture stool of the kind having a knee support on which the user can kneel while seated on the stool, comprising a ground supported frame on which are disposed a seat and knee support which together comprise the posture stool, the arrangement being such that the knee support can be used as a second user seat during exercise and the seat can be moved into a position for use as a back-rest, for use during such seated exercise, a user handle attached to the frame for generally vertical movement, and resistance device on the frame and operatively connected to the handle to resist movement thereof whereby the user can grasp and move the handle to exercise. Preferably, the exercising device comprises a foot rest on the frame substantially at ground level so that the user can stand on the foot rest and thereby stabilize the device with his body weight while grasping and moving the handle to exercise.

17 Claims, 2 Drawing Sheets

PHYSICAL EXERCISING DEVICE

DESCRIPTION

The invention relates to a physical exercising device of a kind particularly, but not exclusively, intended for use in a domestic environment.

It is an object of the invention to provide a physical exercising device which is both small and versatile and which can be used, when not required as an exercising device, as a seat.

According to the invention there is provided a free-standing physical exercising device which can also be used as a posture stool of the kind having a knee support on which the user can kneel while seated on the stool, comprising a ground supported frame on which are disposed a first seat and knee support which together comprise the posture stool, the arrangement being such that the knee support can be used as a second user seat during exercise and that the first seat can be converted into a user back-rest during such seated exercise, a pair of user handles attached to the frame for generally vertical movement, resistance means on the frame and operatively connected to resist movement of the handles whereby the user can grasp and move the handles to exercise, and a user foot rest on the frame substantially at ground level so that the user can stand on the foot rest and stabilise the device with his body weight during exercise.

The handles are preferably provided on a lever pivoted on the frame.

Preferably the first seat can be pivoted from a generally horizontal position, in which it is used as the posture stool seat, to a position in which the first seat can form a back-rest when the user is seated on the knee support. Means may be provided for stabilising or fixing the first seat in at least its generally horizontal position. Preferably the knee support is adjustable in position on the frame. The resistance means may comprise one or more hydraulic piston and cylinder devices and preferably the arrangement is such that resistance is produced in both directions of motion so that the user can exercise both by pushing and by pulling on the handles. The resistance means may be adjustably attached to the pivoted levers so that the apparent resistance can be altered. Alternatively the resistance means itself may be adjustable to vary the apparent resistance.

The frame may comprise a pair of mutually spaced generally parallel ground engaging members, one of which may form or carry the foot rest, the members being connected together by a generally horizontal member to one end of which is attached a generally vertical member. An inclined brace is preferably fixed by one end to the vertical member intermediate the ends thereof and by its other end to the other end of the generally horizontal member. The levers are preferably pivoted on the top end of the vertical member. The first seat and the knee support may be fixed to the inclined brace.

The invention is diagrammatically illustrated by way of example in the accompanying drawings in which.

Figure 1:
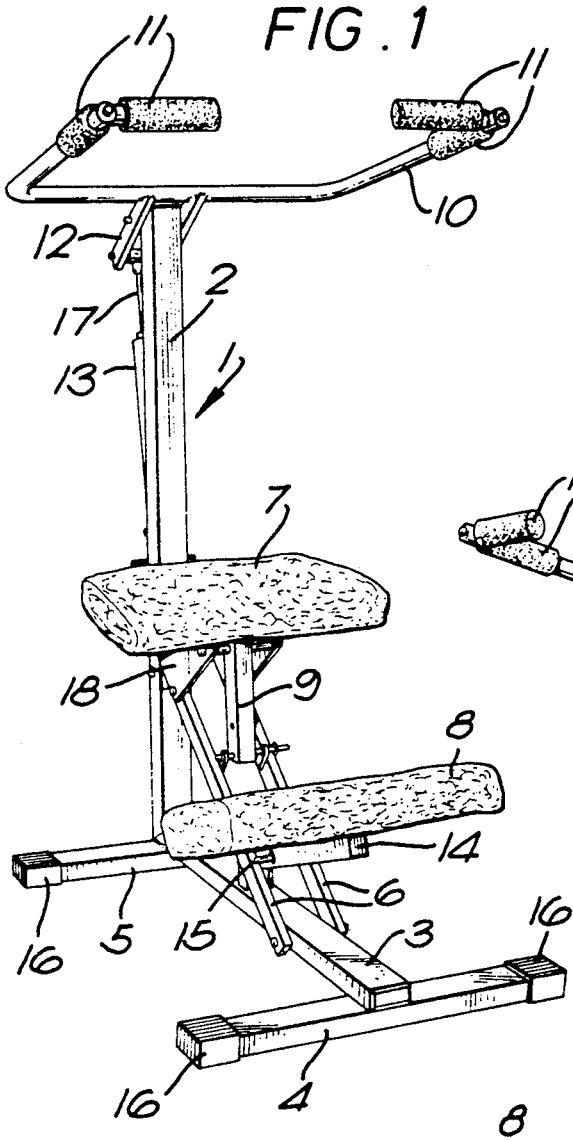
FIG. 1 is a front perspective view of an exercising device embodying the present invention.

In the drawings a free-standing physical exercising device intended for domestic use comprises a generally L-shaped frame 1 having a vertical limb 2 and a horizontal limb 3. The horizontal limb 3 is supported on a pair of generally parallel horizontally disposed cross members 4 and 5 respectively provided at their ends with rubber feet by which the device is stably supported in a free-standing position on a suitable horizontal surface. A pair of inclined braces 6 connect the horizontal limb 3 and the upright limb 2 at positions intermediate the ends of the limbs and mounted on the inclined braces 6 are a first seat 7 and a knee support 8 which together comprise a backless posture stool. Such devices are in themselves well-known and are said to aid correct spinal posture.

Figure 2:
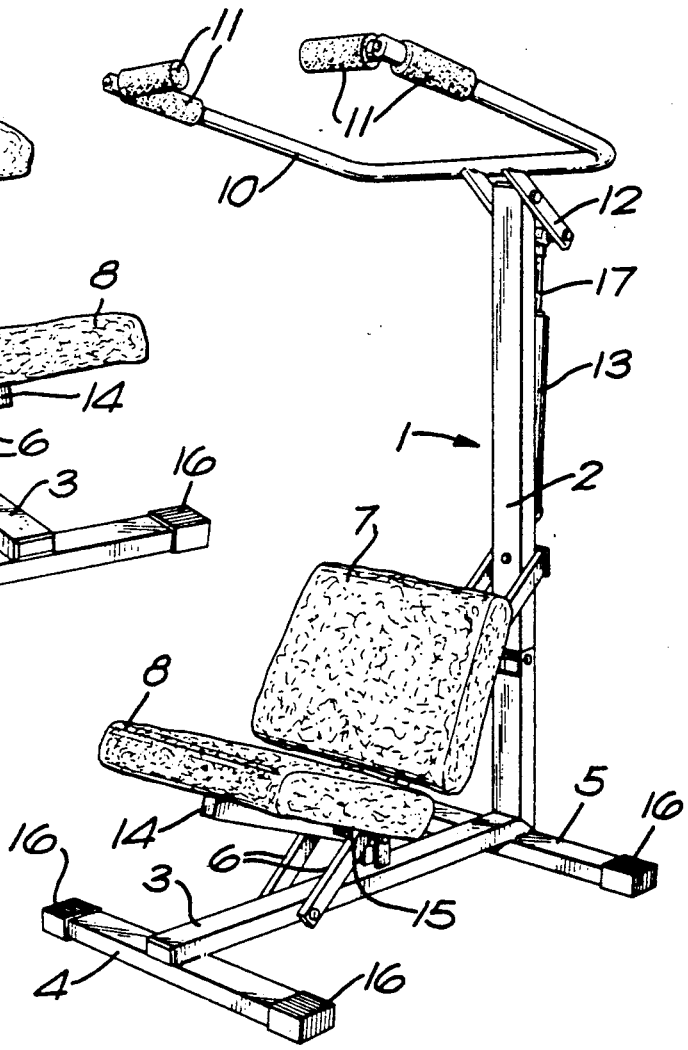
FIG. 2 is a front perspective view from another angle of the exercising device of FIG. 1.
Figure 3:
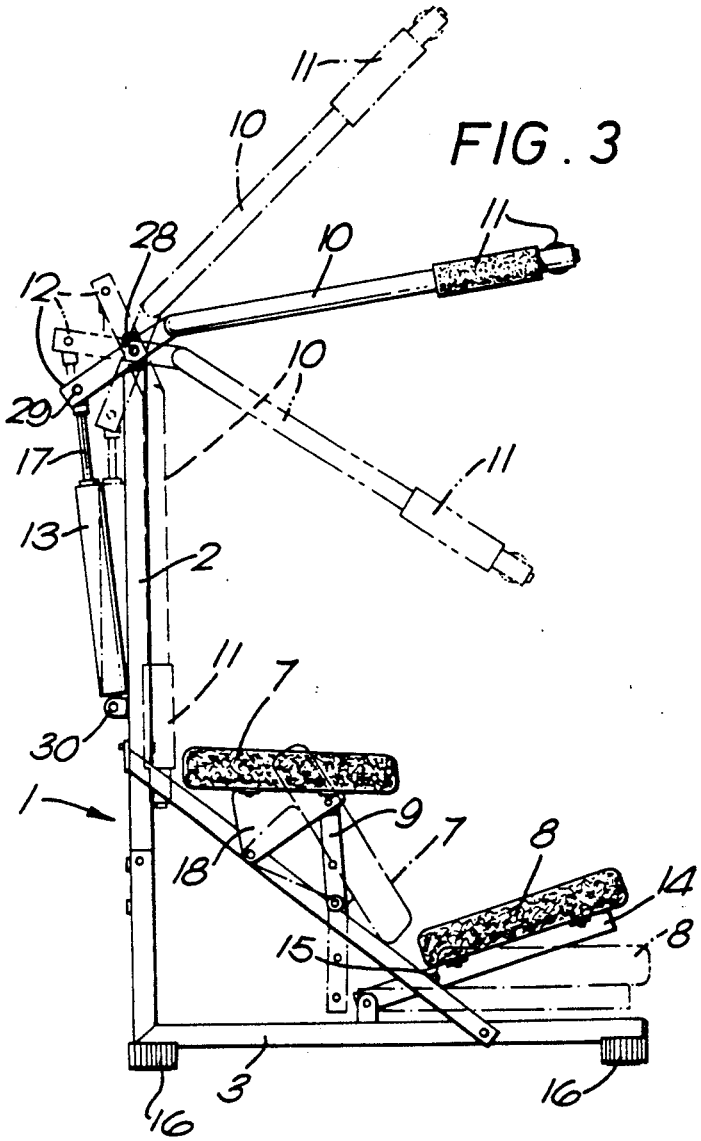
FIG. 3 is a side view of the device of FIGS. 1 and 2.

The knee support 8 is mounted on a member 14 which is pivoted at one end on the limb 3 for movement between the position shown in full lines in FIG. 3 to the position shown in dotted lines in the same view. The member 14 carries a removable cross pin 15 which bears against the braces 6 to support the knee support in the position shown in full lines in FIGS. 1 to 3. The cross pin can be removed to adjust the position of the knee support whereupon it assumes the horizontal position shown in dotted lines in FIG. 3. The seat 7 is pivotally mounted on a bracket 18 on the braces 6 and is adjustably supported by a strut 9 whereby the seat can be tipped from the generally horizontal position shown in FIGS. 1 and 3 to a steeply inclined position shown in FIG. 2 and in dotted lines in FIG. 3 of the drawings and in which it forms a back-rest for use when the user is seated for exercise on the knee support 8.

At the top end of the limb 2 of the frame 1, a lever 10 is pivoted at 28 on the frame for movement about a horizontal axis, the lever 10 being bifurcated and formed at the free ends of its forked portion with handles 11 which may be grasped by the user during exercise. The lever 10 is formed with a rearward extension 12 to the free end of which is pivotally connected at 29 the piston rod 17 of an hydraulic piston and cylinder resistance device 13. The lower end of the resistance device 13 is pivotally mounted at 30 on the limb 2 of the frame. If desired the attachment position of the resistance devices on the extension 12 is adjustable to vary the apparent resistance of the resistance device 13. Alternatively the resistance device may be adjustable to increase or reduce its resistance in known manner.

In use the device may either be used as a posture stool as indicated above, in which case the lever 10 is preferably moved to its lowermost position as indicated in dotted lines in FIG. 3 in which the lever is generally vertical or alternatively the device can be used to exercise in which case the user can be seated on the knee support 8 using the seat 7 in its tipped position as a back-rest as indicated in FIG. 2 and in dotted lines in FIG. 3. In such position the user can exercise by grasping the handles 11 so as to move the lever vertically upwards or downwards against the resistance provided by the resistance device 13. Additional exercises can be performed in a standing position in which case the user will position his feet on the cross member 4 or on the knee support 8 when in its horizontal position to stabilise the device during exercise which will consist of either pulling or pushing the handles 11 in a generally vertical direction.

Figure 4:
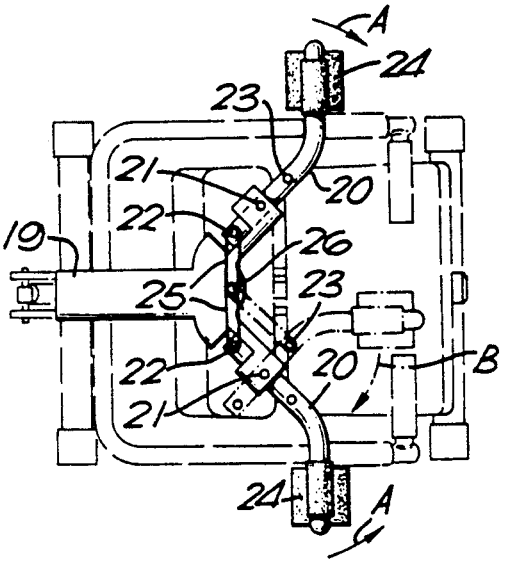
FIG. 4 is a scrap plan view of a modified form of the exercising device of FIGS. 1 to 3.

In FIG. 4 of the drawings there is shown a modification consisting of an additional exercise member which can be secured to the top of the limb 2 to provide an additional range of exercises. The additional exercise member comprises a generally horizontal body 19 fixed by its rear end to the upright limb 2. The forward end of the member 19 carries a pair of levers 20 which are pivoted at 21 on the member 19 for movement in a substantially horizontal plane as indicated by arrows A and B in FIG. 4. The rearward ends of the levers 20 carry upstanding pins 22 and further upstanding pins 23 are provided on the levers 20 on the forward side of the pivots 21. The front ends of the levers 20 carry handles 24 which can be grasped and moved by the user of the apparatus.

Resistance to movement of the levers is provided by strong elastic bands 25 which engage the upright pins 22 and an upstanding pin 26 fixed on the forward end of the member 19 so that movement of the handles 24 towards one another in the direction of the arrows A is resisted. Alternatively the elastic bands 25 are engaged between the upstanding pins 23 and the pin 26 in which case movement of the handles 24 away from one another in the direction of arrow B is resisted. By means of this additional exercise member the exerciser can perform a range of so-called butterfly exercises. Preferably the body 19 is detachable from the limb 2 when not required. Thus the body 19 may be fixed on the limb 2 by means of a simple spigot and socket connection which is preferably square in shape to prevent unintended rotation. The spigot and socket connection may be secured by a pin where additional security is required. If desired the additional exercise member of FIG. 4 can additionally be removably fixed to the frame 1 of the exercising device at the free end of the limb 3 to provide a further range of exercises for the user's legs. Here again the removable connection can be made by a spigot and socket connection of the kind described above.

The apparatus thus provides a simple and inexpensive exerciser having the virtue of being useful as a posture stool when not otherwise in use.

I claim:

1. A free-standing physical exercising device which can also be configured for use as a posture stool of the kind having a knee support on which the user can kneel while seated on the stool, comprising:

a ground supported frame, a seat, a knee support, means for mounting said seat on said frame selectively in either a first position in which said seat is substantially horizontal for use as a seat or in a second position in which said seat is inclined for use as a back rest and has a lower edge thereof adjacent an edge of said knee support, means for mounting said knee support on said frame:

(a) at an elevation below said seat and laterally thereof, (b) with said edge of said knee support being the part thereof closest to said seat in said first and second positions of said seat, and (c) with said knee support inclined upwardly from said edge thereof, a user handle attached to the frame for generally vertical movement, and resistance means on the frame and operatively connected to the handle for resisting movement thereof, whereby the user can grasp and move the handle to exercise.

2. A free-standing physical exercising device according to claim 1, comprising a user foot rest on the frame substantially at ground level so that the user can stand on the foot rest and thereby stabilise the device with his body weight while grasping and moving the handle to exercise.

3. A free-standing physical exercise device according to claim 1, and further comprising a lever pivoted on the frame about a generally horizontal axis, and a pair of handles provided on the lever whereby the handles are movable in a generally vertical arc.

4. A free-standing physical exercise device according to claim 3, wherein the resistance means is adjustably attached to the lever so that the apparent resistance can be altered.

5. A free-standing physical exercise device according to claim 3, wherein the lever is bifurcated into a pair of forked limbs and wherein a handle is disposed at the adjacent ends of the pair of forked limbs.

6. A free-standing physical exercise device according to claim 5, and further comprising a pair of levers pivoted on the frame about a substantially vertical axis for movement towards and away from one another, and a second resistance means connected to said pair of levers for resisting movement thereof to permit butterfly exercise.

7. A free-standing physical exercise device according to claim 1, wherein the means for mounting the seat comprises a horizontal pivot on the frame.

8. A free-standing physical exercise device according to claim 1, wherein said means for mounting the knee support comprises means for mounting said knee support selectively in either said first position or in a second position in which said knee support is substantially horizontal.

9. A free-standing physical exercising device according to claim 8, wherein said means for mounting the knee support comprises means for mounting said knee support substantially at ground level in said second position thereof.

10. A free-standing physical exercise device according to claim 1, wherein the resistance means comprises an hydraulic piston and cylinder device.

11. A free-standing physical exercise device according to claim 10, wherein the resistance means comprises means for producing resistance in both directions of motion so that the user can exercise by moving the handle generally vertically both up and down.

12. A free-standing physical exercise device according to claim 1, wherein the frame comprises a pair of mutually spaced generally parallel ground level cross members, the cross members being connected together by a generally horizontal member to one end of which is attached a generally vertical member.

13. A free-standing physical exercising device according to claim 12, comprising a footrest on one of the cross members.

14. A free-standing physical exercise device according to claim 12, and further comprising an inclined brace fixed at the ends thereof to the generally horizontal and vertical members intermediate the ends thereof.

15. A free-standing physical exercise device according to claim 14, wherein the frame comprises a generally vertical member, and a lever pivoted on the generally vertical member at or near its top end about a generally horizontal axis, and a pair of handles provided on the lever whereby the handles are movable in a generally vertical arc.

16. A free-standing physical exercise device according to claim 14, wherein the seat mounting means and the knee support mounting means mount the seat and knee support on the inclined brace.

17. A free-standing physical exercise device according to claim 1, wherein said means for mounting said knee support comprises means for mounting said knee support selectively in a first position in which said knee support is inclined upwardly from said edge, and in a second position in which said knee support is substantially horizontal.

* * * * *